US005901884A

United States Patent [19]

Goulet et al.

[11] Patent Number: 5,901,884

[45] **Date of Patent: *May 11, 1999**

[54] BEVERAGE DISPENSER

[75] Inventors: Douglas P. Goulet, Big Lake; Joseph W. Bartoletti, Sr., Maple Grove, both of Minn.

[73] Assignee: IMI Cornelius Inc., Anoka, Minn.

[ * ] Notice: This patent issued on a continued prosecution application filed under 37 CFR 1.53(d), and is subject to the twenty year patent term provisions of 35 U.S.C. 154(a)(2).

[21] Appl. No.: 08/761,177

[22] Filed: Dec. 6, 1996

Related U.S. Application Data

[60] Provisional application No. 60/008,378, Dec. 8, 1995.

[51] Int. Cl.[6] ..... B67D 5/62

[52] U.S. Cl. ..... 222/146.6; 62/449; 29/890.035; 29/428

[58] Field of Search ..... 222/146.6, 1; 62/449, 62/392; 29/890.035, 462, 428, 898.07

[56] References Cited

U.S. PATENT DOCUMENTS

| | | | |
|---|---|---|---|
| 2,392,727 | 1/1946 | Dailey | 62/449 |
| 3,116,614 | 1/1964 | King . | |
| 3,541,808 | 11/1970 | Materese . | |
| 3,892,335 | 7/1975 | Schroeder . | |
| 5,234,131 | 8/1993 | Griffin . | |
| 5,499,744 | 3/1996 | Hawkins | 62/392 X |
| 5,711,073 | 1/1998 | Tippmann et al. | 222/146.6 X |
| 5,711,162 | 1/1998 | Wolanin et al. | 29/898.07 X |

FOREIGN PATENT DOCUMENTS

| | | |
|---|---|---|
| 0644387 A1 | 9/1994 | European Pat. Off. . |
| WO91/04450 | 4/1991 | WIPO . |

*Primary Examiner*—Gregory L. Huson
*Attorney, Agent, or Firm*—Sten Erik Hakansou

[57] ABSTRACT

A beverage dispenser includes an outer housing having a water bath tank therein and a refrigeration retaining component area therein positioned directly adjacent and next to the water bath tank. A refrigeration chassis provides for retention and carrying of a refrigeration system including a compressor, a condenser and powered cooling fan and an evaporator. The chassis and refrigeration components form a U-shape wherein one "leg" thereof consists of a rectangular sheet metal frame for retaining the compressor and condenser and the other leg consists of the evaporator. The bridge or end portion of the U-shape consists of a horizontal top plate portion of the chassis and the fluid connection between the evaporator and the condenser. The evaporator is suspended from the horizontal top plate. The U-shape of the chassis and refrigeration components facilitates a method of manufacture. In particular, a carbonator, syrup cooling coils and a water cooling coil are first positioned in the water bath tank at an end thereof adjacent the end of the housing on which a plurality of beverage dispensing valves are secured. The assembled chassis with refrigeration components secured thereto is then lifted and lowered into the dispenser housing wherein the evaporator is placed into the water bath tank along an end thereof opposite from the carbonator and cooling coils, and where the compressor and condenser are placed into the refrigeration component retaining area.

14 Claims, 6 Drawing Sheets

32
38
36
32
32

BEVERAGE DISPENSER

This application claims the benefit of U.S. Provisional Applicatoin Ser. No. 60/008,378, filed Dec. 8, 1995.

FIELD OF THE INVENTION

The present invention relates generally to beverage dispensing machines, and in particular to electrically cooled beverage dispensing machines.

BACKGROUND OF THE INVENTION

Electrically cooled beverage dispensing machines are well known in the art and include the standard refrigeration apparatus of a compressor, condenser and evaporator. Such dispensers will also include a water bath in which the evaporator resides, and on which ice is formed. Heat exchange beverage cooling coils extend through the water bath for cooling the beverage constituents therein as they travel from sources thereof to beverage dispensing valves. There exists a constant desire to arrange these various components in ways that will provide for the most efficient use of space, that will provide for fast heat exchange and that will facilitate low cost construction.

SUMMARY OF THE INVENTION

The present invention concerns an electrically cooled beverage dispenser that provides for compact structure, good heat exchange and much simplified construction. The invention herein includes an outer housing having a water bath tank therein and a refrigeration retaining component area therein positioned directly adjacent and next to the water bath tank. A refrigeration chassis provides for retention and carrying of a refrigeration system including a compressor, a condenser and powered cooling fan and an evaporator. The chassis and refrigeration components form a U-shape wherein one "leg" thereof consists of a rectangular sheet metal frame for retaining the compressor and condenser and the other leg consists of the evaporator. The bridge or end portion of the U-shape consists of a horizontal top plate portion of the chassis and the fluid connection between the evaporator and the condenser. The evaporator is suspended from the horizontal top plate.

The U-shape of the chassis and refrigeration components facilitates a very easy and non time consuming method of manufacture. In particular, a carbonator, syrup cooling coils and a water cooling coil are first positioned in the water bath tank at an end thereof adjacent the end of the housing on which a plurality of beverage dispensing valves are secured. The assembled chassis with refrigeration components secured thereto is then lifted and simply lowered into the dispenser housing wherein the evaporator is placed into the water bath tank along an end thereof opposite from the carbonator and cooling coils, and where the compressor and condenser are placed into the refrigeration component retaining area. The chassis horizontal top plate is then secured to a top perimeter of the housing. Thus, it was found that by designing the refrigeration components to be a separate unit that can be individually assembled and then placed into the dispenser in essentially one operation, provided for significant reduction in time of assembly, and therefore, important reductions in labor cost. It can also be understood that servicing of the present invention is enhanced by the ease with the assembly can be reversed to, for example, remove refrigeration components.

DESCRIPTION OF THE INVENTION

A better understanding of the structure, function and objects and advantages of the present invention can be had by reference to the following detailed description which refers to the following figures, wherein:

FIG. 1 shows a side plan view of the present invention.

FIG. 2. shows a side plan view of the dispenser herein without the refrigeration chassis therein.

FIG. 3. shows a side plan view of the refrigeration chassis.

FIG. 4. shows a top plan view along lines 4—4 of FIG. 1.

FIG. 5. shows a perspective view of the lower portion of the refrigeration chassis.

FIG. 6 shows an exploded view of the present invention.

DETAILED DESCRIPTION

Figure 1:
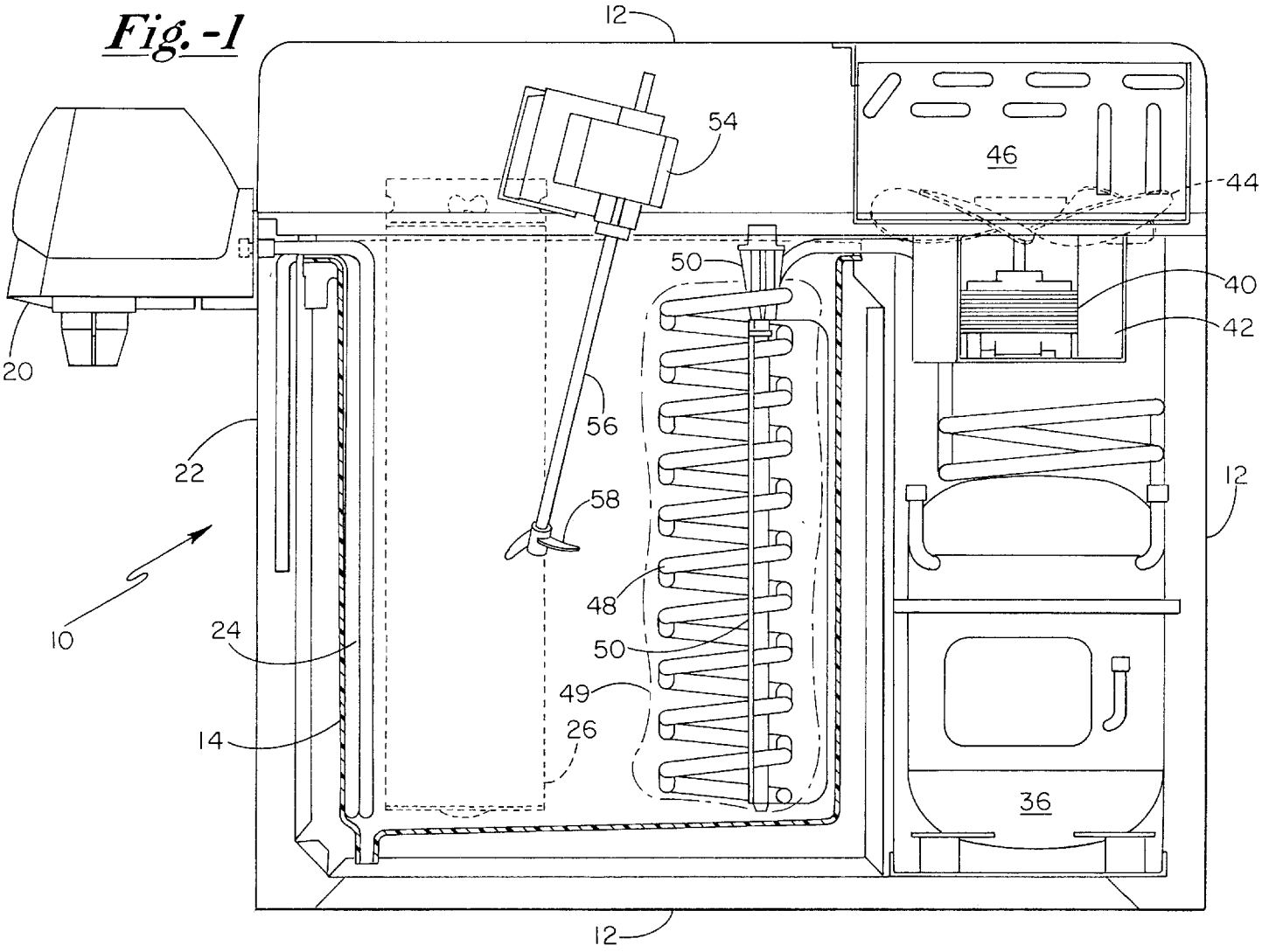

The dispenser of the present invention is seen in the various figures and generally indicated by the numeral 10. Dispenser 10 includes an outer housing 12 having a water bath tank 14 therein. Tank 14 and housing 12 serve to defining a refrigeration component containing area 16. One or more beverage dispensing valves 20 are secured to a front panel 22 of dispenser 10. Each valve is connected to a heat exchange syrup coil 24 as described in co-provisional period pending U.S. provisional filed Dec. 7, 1995 attorney file number 1A9514.PV. Tank 14 also holds a carbonator 26 as described in co-provisional period pending U.S. provisional filed Dec. 7, 1995 attorney file number 1A9513.PV. Fluid lines, (not shown), serve to connect carbonator 26 with each of the valves 20. A water coil 28 resides in tank 14, along with syrup coils 24 and carbonator 26 along the end of tank 14 adjacent valves 20 and front panel 16.

Figure 3:
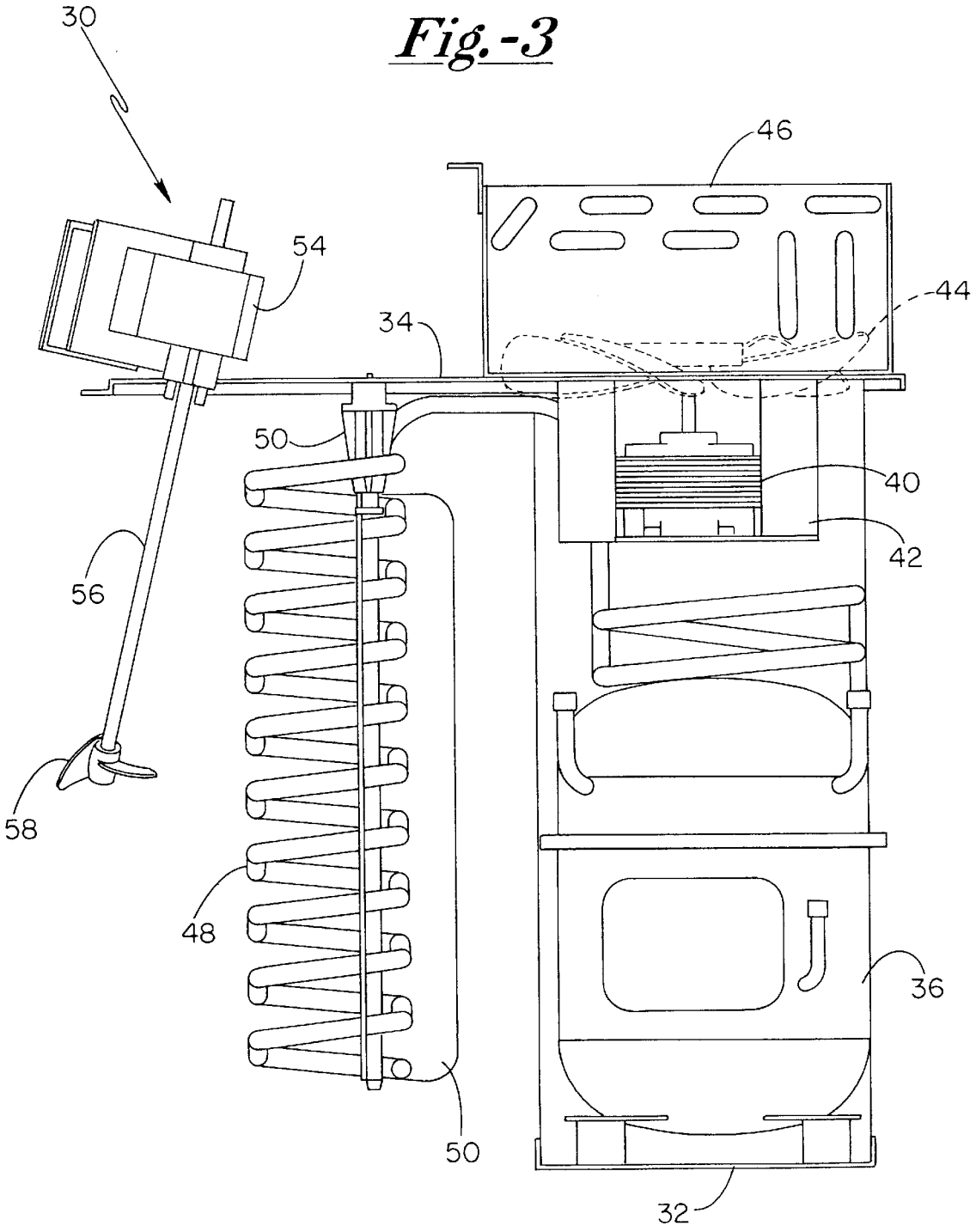
Figure 4:
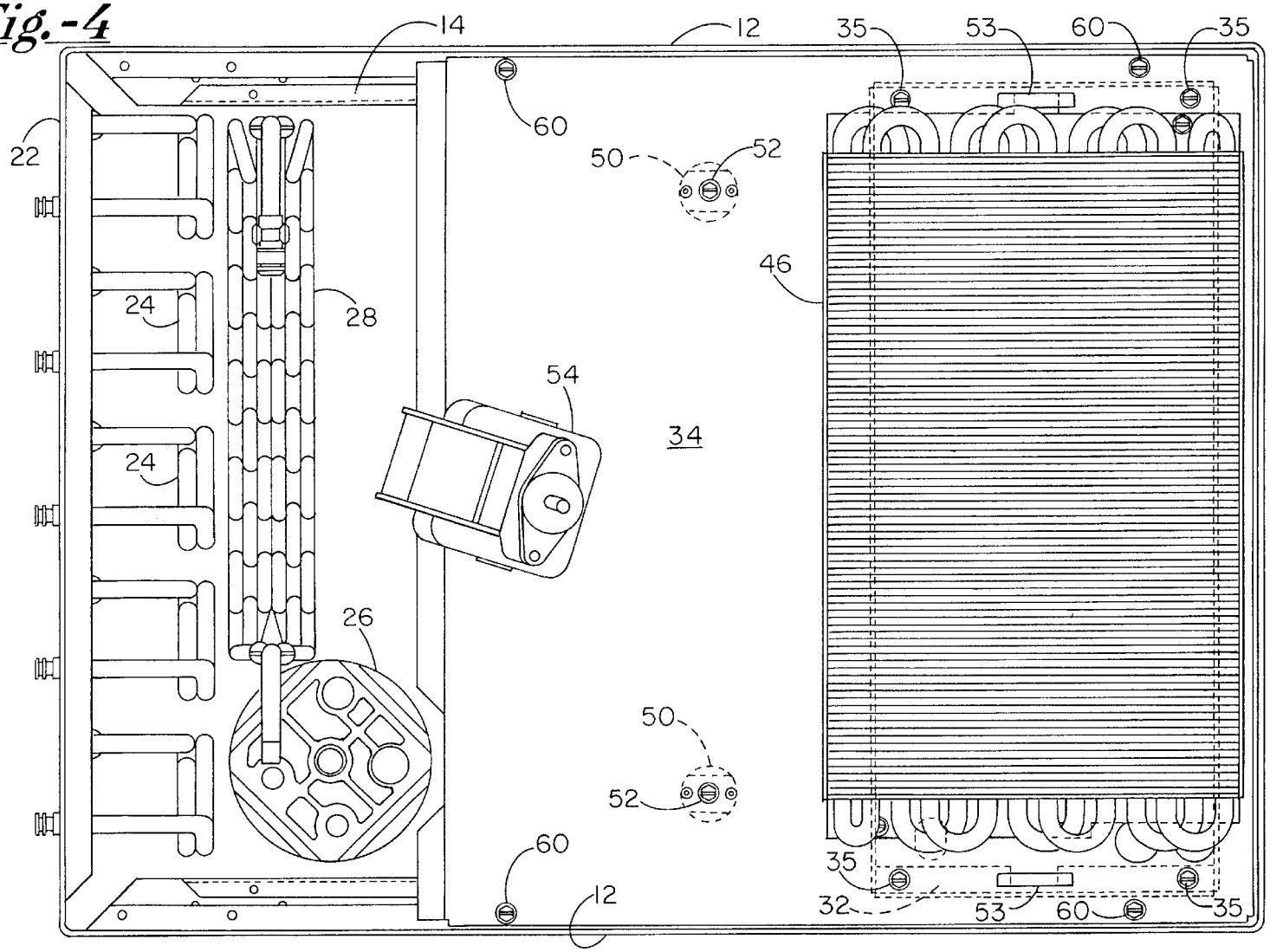
Figure 5:
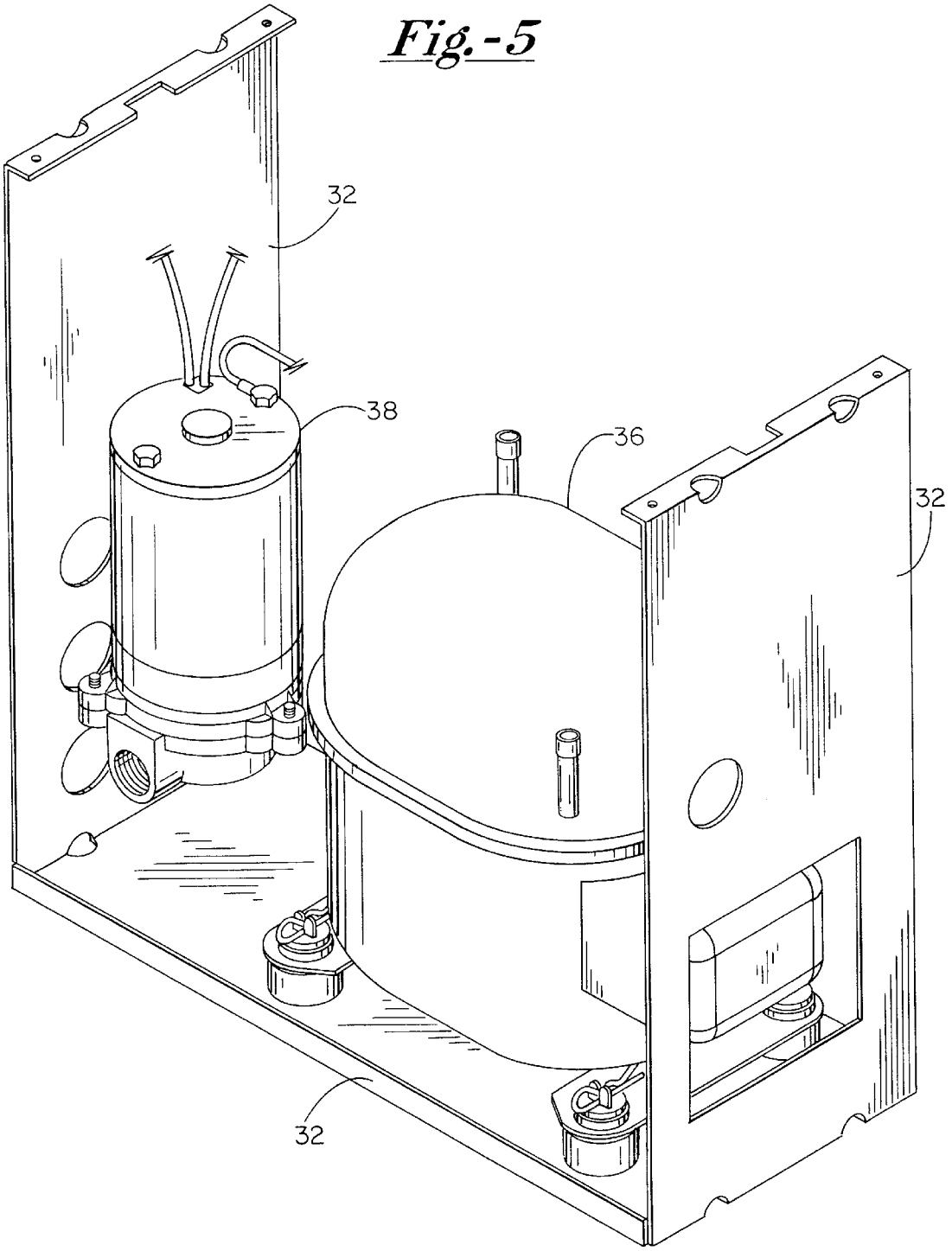
Figure 6:
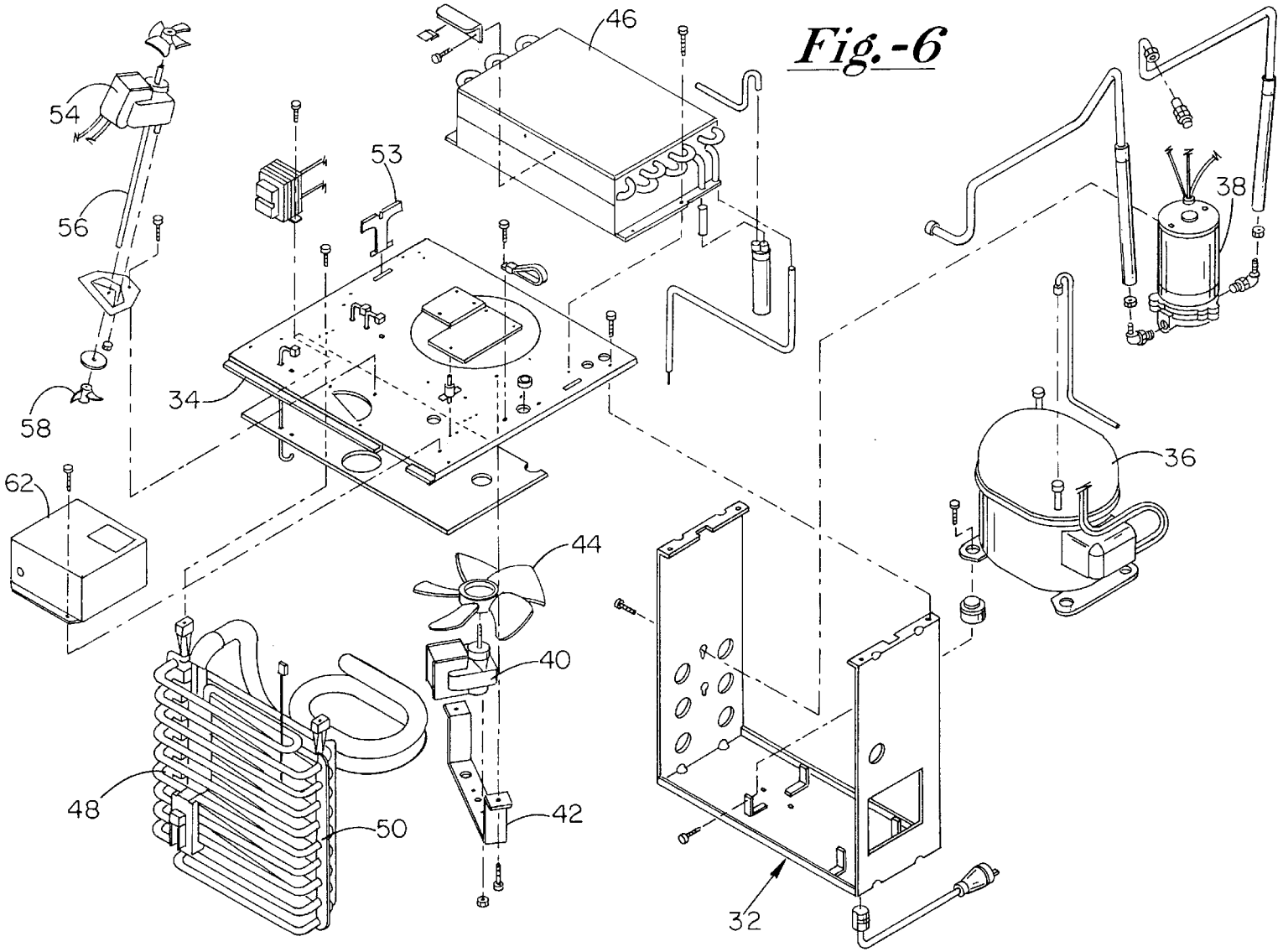

As seen specifically in FIG. 3, a unitary refrigeration chassis is shown and generally referred to by the numeral 30. As seen by also referring to FIGS. 4 and 5, chassis 30 includes a lower U-shaped sheet metal frame portion 32 and a horizontal sheet metal frame member 34 secured thereto by attachment means 35. A compressor 36 and a water pump 38 are secured within frame portion 32. A condenser fan motor 40 is suspended from horizontal portion 34 by a bracket 42 secured thereto. Motor 40 drive a fan 44 for cooling a condenser 46 secured there above to a top surface of horizontal frame portion 34. An evaporator 48 is suspended from and below frame portion 34 by a condenser coil retaining and separating frame 50 secured by attachment means 52 to horizontal frame portion 34. As is known by those of skill, an ice bank 49 is formed on evaporator 48 by the cooling operation fo compressor 36 and condenser 46. A pair of chassis lifting handles 53 are secured to chassis 30 at the junction of lower portion 32 and horizontal portion 34. An agitator motor 54 is secured at an angled orientation to horizontal portion 34 and includes a shaft 56 and agitator propeller 58 for agitating water in tank 14.

Figure 2:
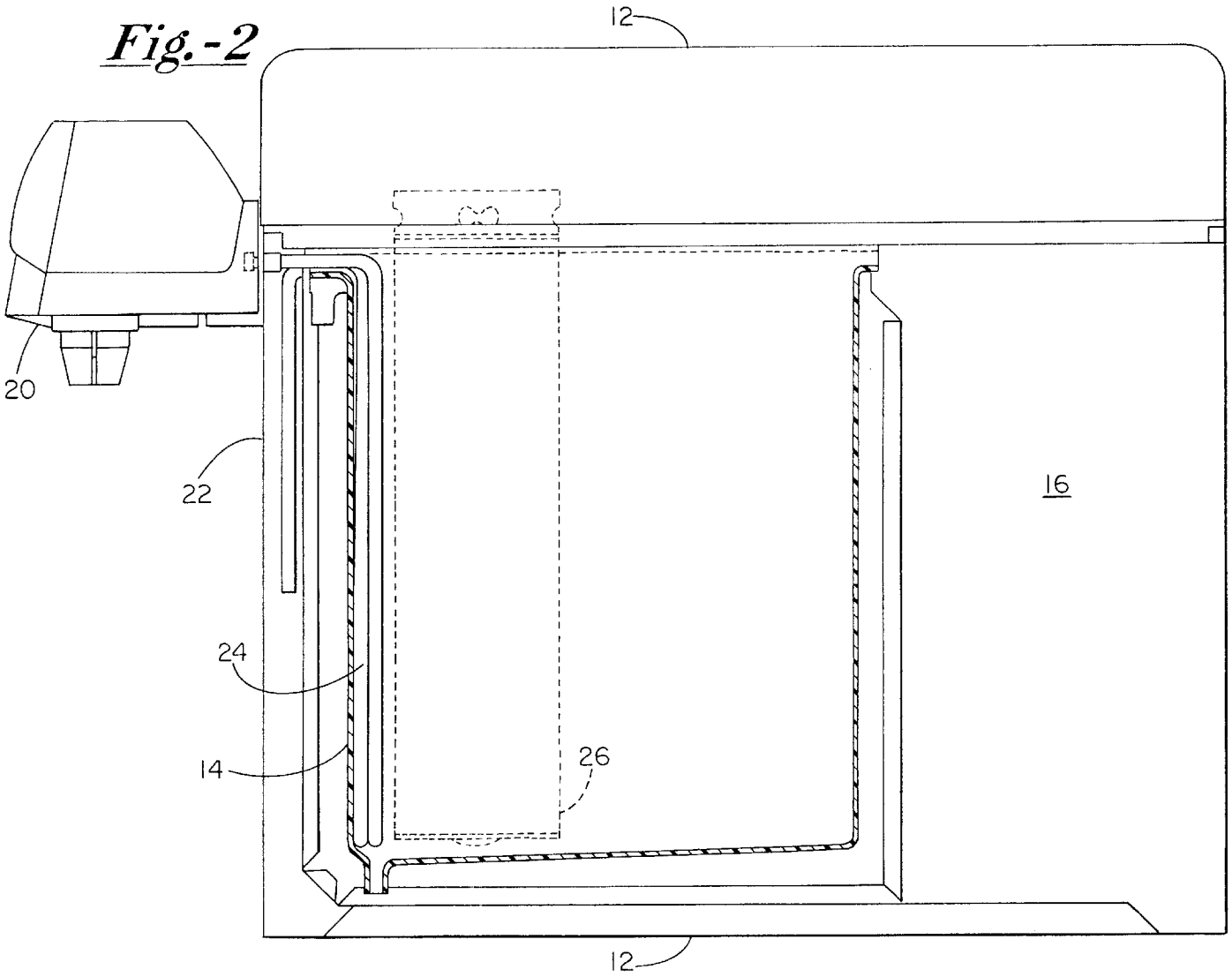

A major advantage of the dispenser of the present invention concerns the fact that the structure thereof lends itself to very efficient and low cost manufacture. It will be understood that the portion of the dispenser seen in FIG. 2, including the housing 12, water tank 14, valves 20, panel 22, coils 24 and 28 and carbonator can all be assembled on their own, that is, separately from the manufacture of chassis 30. Thus, chassis 30 and its associated components can be assembled separately from and parallel with the assembly of the remainder of dispenser 10 as represented in FIG. 2. Additionally, these two major portions of dispenser 10 can then be assembled together relatively easily and quickly. In particular, chassis 30 is lowered into housing 12 whereby chassis lower frame portion 34 and the components secured thereto are positioned in area 16, while at the same time evaporator 48 is positioned in tank 14. Chassis 30 is then secured to housing 12 by, for example, screw attachment means 60. Conceptually then, dispenser 10 is viewed as consisting of two major components that can be assembled in parallel, thereby reducing the time of manufacture compared to a completely linear manufacture thereof. It will be understood that the refrigeration components are "fluidly" separate from the beverage containing elements, thus facilitating this two component approach. Other than the fluid connection between pump 38 and coils 28, chassis 30 is purely a "drop in" component. In addition, it will be appreciated by those of skill that various electrical control components 62, are used to control, for example, the operation of compressor 36, pump 38, and agitator 54. Such electronics can be place on the top surface of horizontal chassis frame portion 34, and are thus also substantially associated with the manufacture of chassis 30. As is known in the art, one electrical connection is need from such controls to a liquid level sensing means of carbonator 26. It can also be understood that a major advantage of the present invention concerns the ease of repair thereof, especially with respect to the removal of the refrigeration chassis 30 for facilitating access to many of the parts of dispenser, and in particular for access to and repair of the specific components associated therewith.

The angled orientation of agitator motor 54 facilitates a good flow of water in the direction of carbonator 26 and coils 24 and 28 to facilitate the heat exchange cooling thereof. Also, the positioning of coils 24 and 28 and carbonator 26 along a common end of tank 14 while the evaporator coils 48 extend along an opposite wall thereof provides for efficient utilization of water bath tank space.

We claim:

1. A beverage dispenser, comprising:

a lower housing, the lower housing having a top end and a bottom end and four side walls extending therebetween defining an interior housing area, and defining a dispenser front end and a dispenser rear end opposite there from, and the dispenser front end for suspending one or more beverage dispensing valves thereon, the interior housing area divided into a water bath tank area and a component receiving area, the water bath tank for holding a volume of water therein fluidly separate from the component area, and the water bath tank having a front end adjacent the dispenser front end, and the component receiving area having a rear end adjacent the dispenser rear end, one or more beverage lines secured to the one or more valves for delivering beverage thereto from one or more corresponding sources thereof, each one or more line having a heat exchange portion extending through the water bath tank for providing heat exchange contact with the water therein, a component chassis having a substantially horizontal frame member, the frame member having top and bottom support surfaces and extending from a first end to a second end thereof, refrigeration means for providing cooling of the water held in the water bath tank, the refrigeration means including a condenser secured adjacent the top surface of the horizontal frame member and adjacent the second end thereof, a refrigeration compressor secured to the bottom surface of the horizontal frame member adjacent the second end thereof, and a refrigeration evaporator secured to the bottom surface of the horizontal frame member and spaced from the refrigeration compressor in a direction towards the horizontal frame member first end and the component chassis secured to the lower housing whereby the refrigeration compressor is positioned in the component receiving area and the refrigeration evaporator is suspended in the water bath tank.

2. A beverage dispenser as defined in claim 1, and further including an agitator motor having a shaft and an agitating means on the end thereof and the agitator motor secured to the horizontal frame member so that the shaft thereof extends into the water bath tank for providing agitating thereof by the agitating means.

3. A beverage dispenser as defined in claim 1, and further including a carbonator located in the water bath tank, the carbonator connected to a source of potable water and a source of carbon dioxide gas and the carbonator having one or more carbonated water lines for connecting to the one or more beverage dispensing valves.

4. A beverage dispenser as defined in claim 3, and further including a pump for pumping water from the potable source thereof to the carbonator and the pump secured to the component chassis for positioning in the component receiving area.

5. A beverage dispenser as defined in claim 1, and the heat exchange portion of the beverage lines comprising coils extending substantially vertically and positioned adjacent the water bath tank front end.

6. A beverage dispenser as defined in claim 2, and the heat exchange portion of the one or more beverage lines comprising coils extending substantially vertically and positioned adjacent the water bath tank front end and the agitator shaft positioned at an angle to direct a flow of water in the water bath tank towards the heat exchange portion of the one or more beverage lines.

7. A beverage dispenser as defined in claim 1, and the refrigeration condenser including a cooling fan positioned between it and the refrigeration compressor.

8. A beverage dispenser as defined in claim 1, and further including a carbonator located in the water bath tank, the carbonator connected to a pump and the pump connected to a source of potable water, the carbonator also connected to a source of carbon dioxide gas and the carbonator having one or more carbonated water lines for connecting to the one or more beverage dispensing valves, and the pump secured to the component chassis for positioning in the component receiving area.

9. A beverage dispenser as defined in claim 8, and the refrigeration condenser including a cooling fan positioned between it and the refrigeration compressor.

10. A beverage dispenser as defined in claim 9, and the heat exchange portion of the one or more beverage lines comprising coils extending substantially vertically and positioned adjacent the water bath tank front end.

11. A beverage dispenser as defined in claim 10, and further including an agitator motor having a shaft and an agitating means on the end thereof and the agitator motor secured to the horizontal frame member so that the shaft thereof extends into the water bath tank for providing agitating thereof by the agitating means.

12. A beverage dispenser as defined in claim 11, and the agitator shaft positioned at an angle to direct a flow of water in the water bath tank towards the heat exchange portion of the one or more beverage lines.

13. A method of manufacturing a beverage dispenser, the beverage dispenser having a lower housing, the lower housing having a top end and a bottom end and four side walls extending therebetween defining an interior housing area, and defining a dispenser front end and a dispenser rear end opposite there from, and the dispenser front end for suspending one or more beverage dispensing valves thereon, the interior housing area divided into a water bath tank area and a component receiving area, the water bath tank for holding a volume of water therein and fluidly separate from the component area, and the water bath tank having a front end adjacent the dispenser front end, and the component receiving area having a rear end adjacent the dispenser rear end, one or more beverage lines secured to the one or more valves for delivering beverage thereto from one or more corresponding sources thereof, each one or more line having a portion extending through the water bath tank for providing heat exchange contact with the water therein, a component chassis having a substantially horizontal frame member, the frame member having top and bottom support surfaces and extending from a first end to a second end thereof, refrigeration means for providing cooling of water held in the water bath tank, the refrigeration means including a condenser secured adjacent the top surface of the component chassis and adjacent the second end thereof, a refrigeration compressor secured to the bottom surface of the component chassis adjacent the second end thereof, and a refrigeration evaporator secured to the bottom surface of the component chassis and spaced from the refrigeration compressor in a direction towards the component chassis first end, the method of manufacturing comprising the steps of:

forming the dispenser housing and securing the one or more valves thereto, forming the component chassis and securing the compressor and evaporator thereto, positioning a completed component chassis above the dispenser housing wherein the component chassis first end is above the dispenser housing front end and the component chassis second end is above the dispenser housing rear end, and lowering the component chassis so that the refrigeration compressor is positioned within the component receiving area and so that the refrigeration evaporator is suspended in the water bath tank, and securing the component chassis to the dispenser housing.

14. The method as defined in claim 13, and the steps of forming the dispenser housing and forming the component chassis performed in parallel.

* * * * *